US006155315A

United States Patent [19]

Peterson

[11] Patent Number: 6,155,315

[45] Date of Patent: Dec. 5, 2000

[54] FUNNEL WITH SPILL GUARD

[76] Inventor: Willis H. Peterson, 6807 Hwy. 32 South, Lisbon, N. Dak. 58054

[21] Appl. No.: 09/314,438

[22] Filed: May 19, 1999

Related U.S. Application Data

[60] Provisional application No. 60/104,790, Oct. 19, 1998.

[51] Int. Cl.[7] ..... B67C 11/04

[52] U.S. Cl. ..... 141/331; 141/340

[58] Field of Search ..... 141/331, 333, 141/335–340, 363–366, 383, 384, 311 R, 297, 299, 300; 215/306; 222/111

[56] References Cited

U.S. PATENT DOCUMENTS

| | | | |
|---|---|---|---|
| 334,564 | 1/1886 | Catlin | 141/299 |
| 1,953,633 | 4/1934 | Ramos | 215/306 |
| 4,600,125 | 7/1986 | Maynard, Jr. | 222/81 |
| 5,074,343 | 12/1991 | Tyree, Jr. | 141/300 |

*Primary Examiner*—Charles R. Eloshway
*Assistant Examiner*—Timothy L. Maust
*Attorney, Agent, or Firm*—Michael S. Neustel

[57] ABSTRACT

A funnel with spill guard for preventing the contents of a liquid container from overflowing. The inventive device includes a funnel member having an open end, a tapered body, a neck, a threaded nipple within the neck, and an extended tube extending from the neck and the threaded nipple. The extended tube extends into the container thereby creating an air pocket of equal height that preferably has a volume sufficient to receive the entire contents of the funnel member. The air pocket is sealed within the container between the liquid level and the threaded nipple until the user loosens the threaded nipple to allow the air within the air pocket to escape. The extended tube preferably includes a filter member for catching debris within the fluid.

7 Claims, 5 Drawing Sheets

FUNNEL WITH SPILL GUARD

CROSS-REFERENCE TO RELATED U.S. PATENT APPLICATION

I hereby claim benefit under Title 35, United States Code, Section 119(e) of U.S. provisional patent application Ser. No. 60/104,790 filed Oct. 19, 1998. This application is a continuation of the Ser. No. 60/104,790 application. The Ser. No. 60/104,790 application is currently pending.

BACKGROUND OF THE INVENTION

1. Field of the Invention

The present invention relates generally to funnel devices and more specifically it relates to a funnel with spill guard for preventing the contents of a liquid container from overflowing.

Liquid containers, such as liquid waste barrels, are often filled utilizing a conventional funnel. Some funnels have threaded ends for threadably engaging a threaded female nipple of the container. During filling, if the user does not observe the level of fluid within the container by looking into the container through the funnel or pulling the funnel out, the liquid within the container will often times overflow from within the drum onto the upper and side surfaces of the container. Hence, there is a need for a funnel device that reduces the chances of overflowage during filling of a container.

2. Description of the Prior Art

Funnel devices have been in use for years. Typically, a funnel device has a broad upper open end that tapers to a narrow nozzle portion that is insertable into a fluid container. The user typically inserts the fluid or waste into the broad end where after it is dispensed through the narrow nozzle portion.

During filling, the fluid fills the fluid container until the fluid level rises above the upper surface of the container where after the fluid escapes through the threaded opening of the container. If the user has a funnel with a threaded nozzle portion, then the fluid reaches the upper surface of the container and terminates filling the container however the funnel retains a significant amount of fluid that must be drained out prior to removing the funnel to prevent spillage.

While these devices may be suitable for the particular purpose to which they address, they are not as suitable for preventing the contents of a liquid container from overflowing. Conventional funnel devices are extremely prone to overflowage thereby creating an extremely dirty exterior of the container and potentially contaminating the environment surrounding the container with hazardous chemicals.

In these respects, the funnel with spill guard according to the present invention substantially departs from the conventional concepts and designs of the prior art, and in so doing provides an apparatus primarily developed for the purpose of preventing the contents of a liquid container from overflowing.

SUMMARY OF THE INVENTION

In view of the foregoing disadvantages inherent in the known types of funnel devices now present in the prior art, the present invention provides a new funnel with spill guard construction wherein the same can be utilized for preventing the contents of a liquid container from overflowing.

The general purpose of the present invention, which will be described subsequently in greater detail, is to provide a new funnel with spill guard that has many of the advantages of the funnel devices mentioned heretofore and many novel features that result in a new funnel with spill guard which is not anticipated, rendered obvious, suggested, or even implied by any of the prior art funnel devices, either alone or in any combination thereof.

To attain this, the present invention generally comprises a funnel member having an open end, a tapered body, a neck, a threaded nipple within the neck, and an extended tube extending from the neck and the threaded nipple. The extended tube extends into the container thereby creating an air pocket of equal height that preferably has a volume sufficient to receive the entire contents of the funnel member. The air pocket is sealed within the container between the liquid level and the threaded nipple until the user loosens the threaded nipple to allow the air within the air pocket to escape. The extended tube preferably includes a filter member for catching debris within the fluid.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a funnel with spill guard that will overcome the shortcomings of the prior art devices.

Another object is to provide a funnel with spill guard that prevents the overflowage of fluid within a container.

An additional object is to provide a funnel with spill guard that is of a simple construction.

A further object is to provide a funnel with spill guard that creates an air pocket within the upper portion of the container sufficient to receive the entire contents of the funnel.

Another object is to provide a funnel with spill guard that terminates the flowage of liquid into the container upon the liquid level reaching a specific level.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
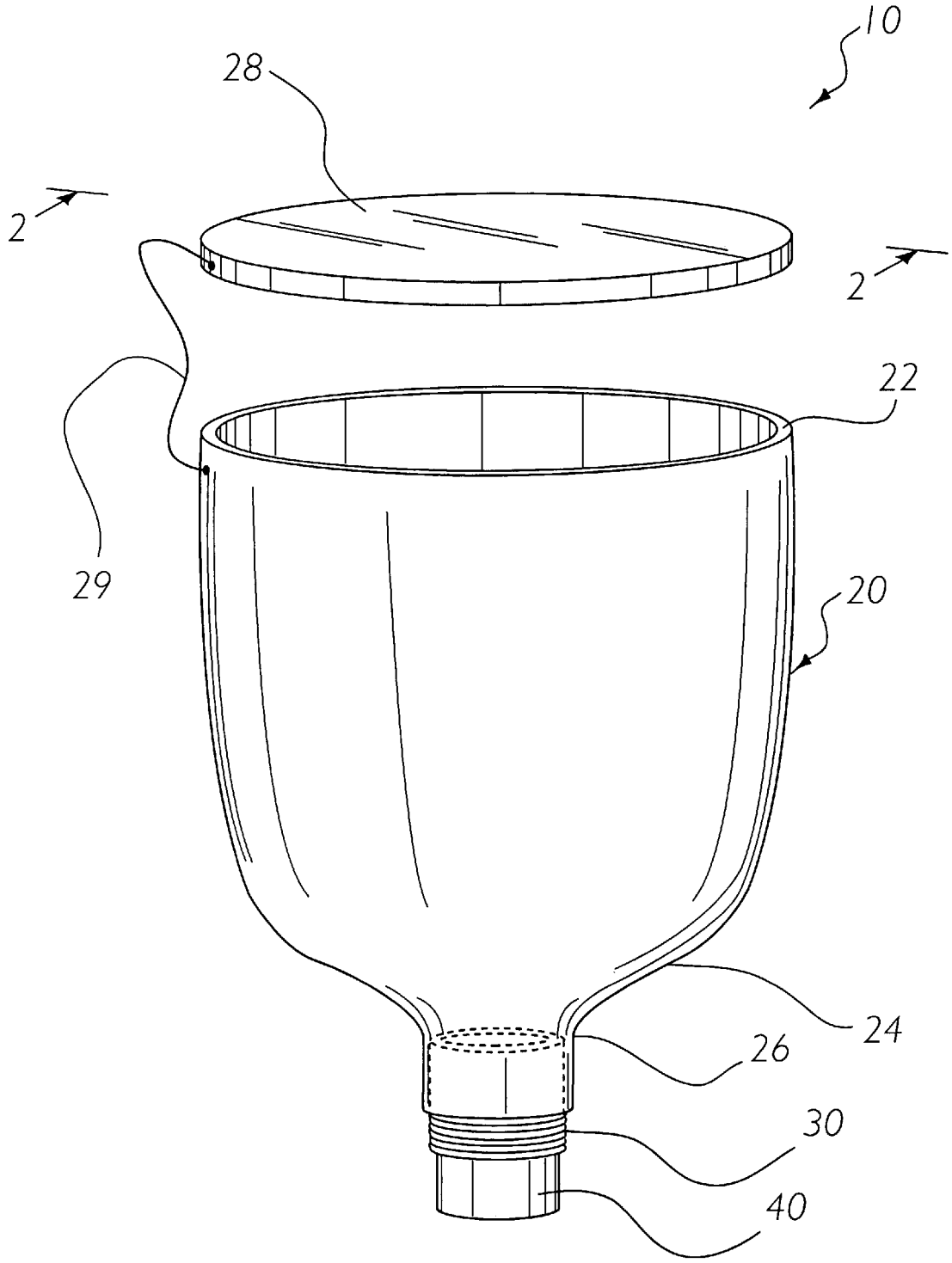
FIG. 1 is an upper perspective view of the present invention.

Turning now descriptively to the drawings, in which similar reference characters denote similar elements throughout the several view, FIGS. 1 through 5 illustrate a funnel with spill guard 10, which comprises a funnel member 20 having an open end 22, a tapered body 24, a neck 26, a threaded nipple 30 within the neck 26, and an extended tube 40 extending from the neck 26 and the threaded nipple 30. The extended tube 40 extends into the container 12 thereby creating an air pocket 18 of equal height that preferably has a volume sufficient to receive the entire contents of the funnel member 20. The air pocket 18 is sealed within the container 12 between the liquid level 16 and the threaded nipple 30 until the user loosens the threaded nipple 30 to allow the air within the air pocket 18 to escape. The extended tube 40 preferably includes a filter member 44 for catching debris within the fluid 14.

As shown in FIGS. 1 through 5 of the drawings, the funnel member 20 includes an open end 22, a tapered-body 24 and a neck 26. It can be appreciated by one skilled in the art that the funnel member 20 may have various shapes and sizes. As shown in FIG. 1 of the drawings, a cover 28 is preferably provided that selectively encloses the open end 22 of the funnel member 20. The cord 29 is preferably attached between the cover 28 and the funnel member 20 for preventing loss of the cover 28 during usage.

Figure 2:
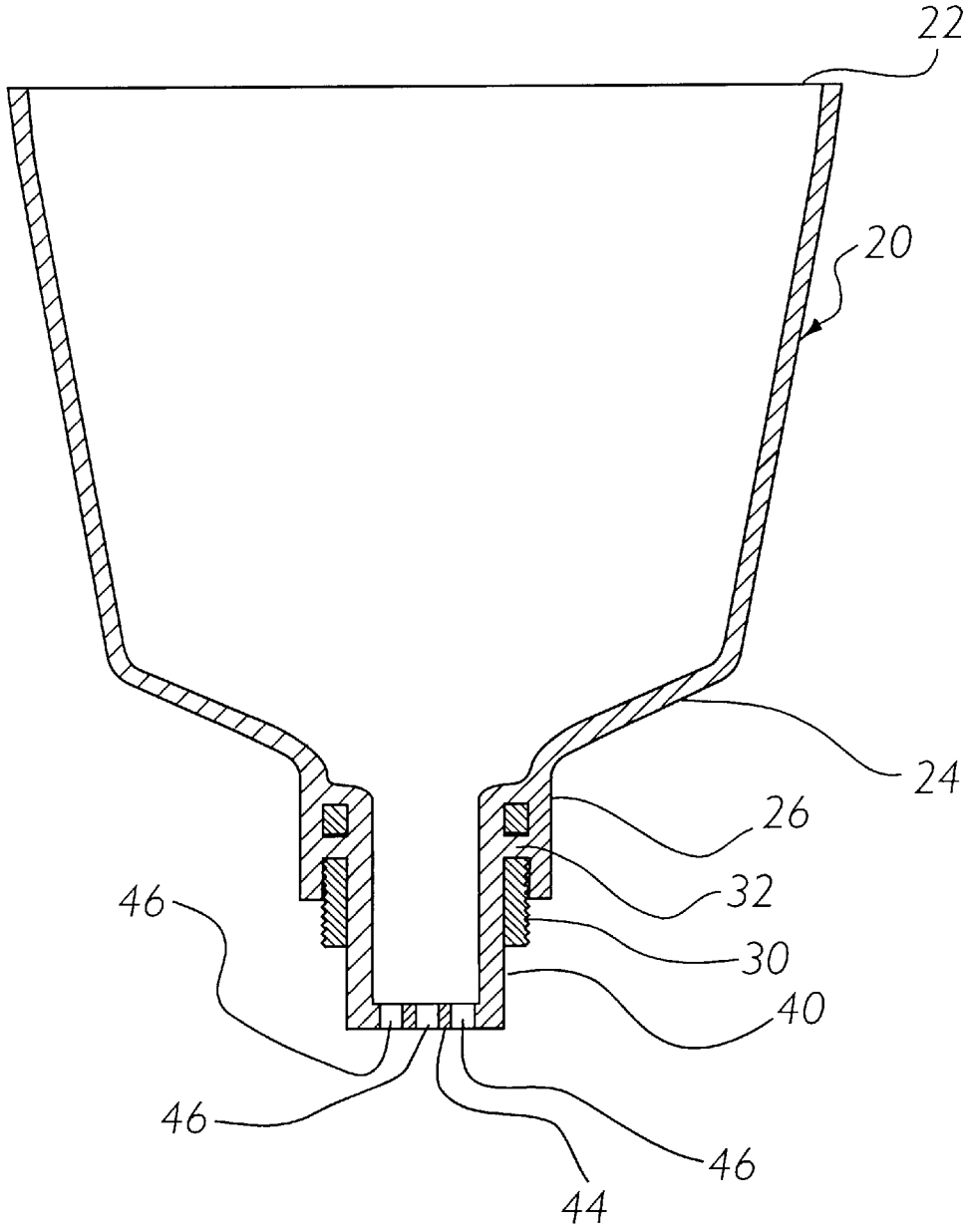
FIG. 2 is a cross sectional view taken along line 2—2 of FIG. 1.
Figure 3:
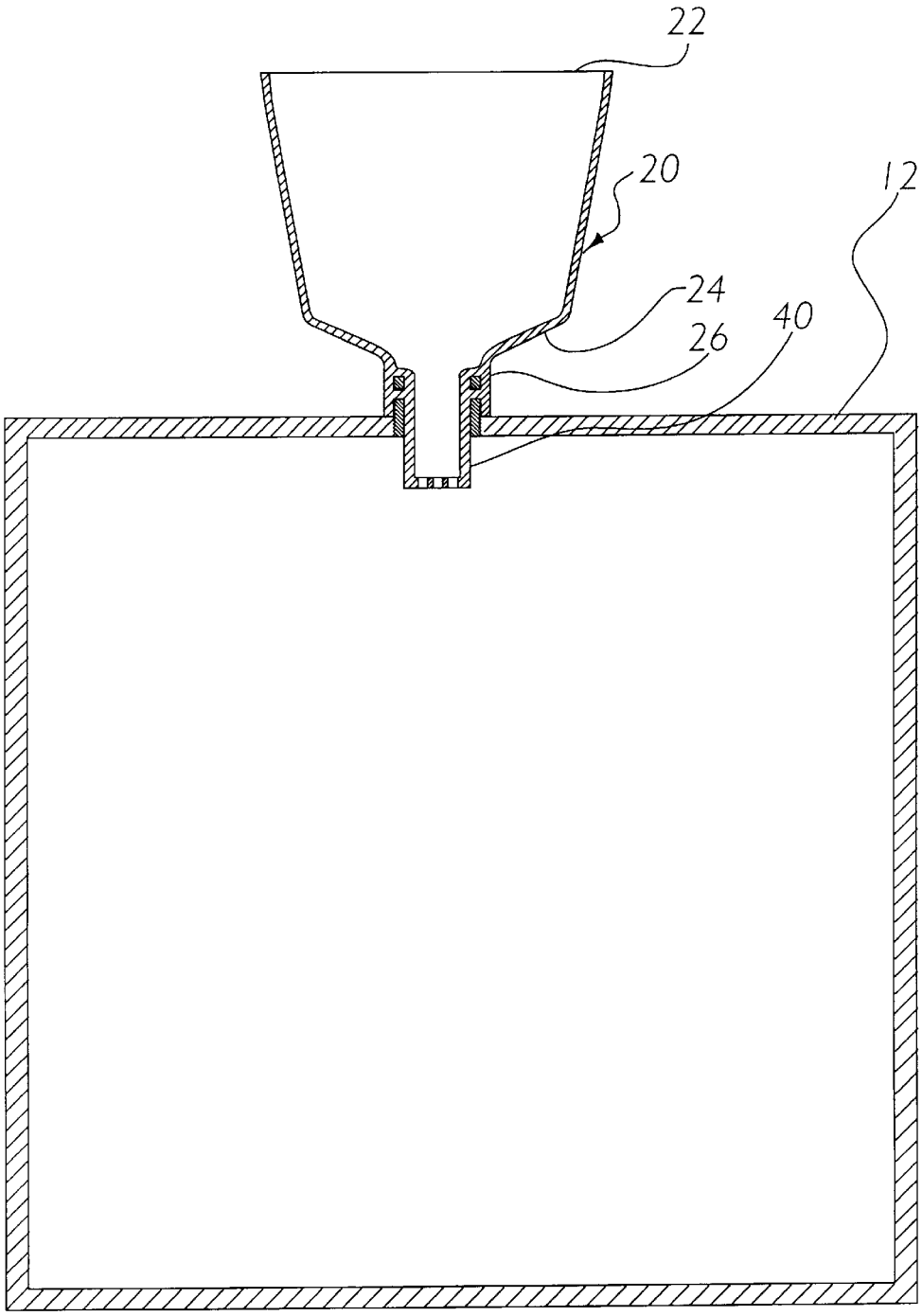
FIG. 3 is a cutaway view with the funnel member attached to a container.
Figure 4:
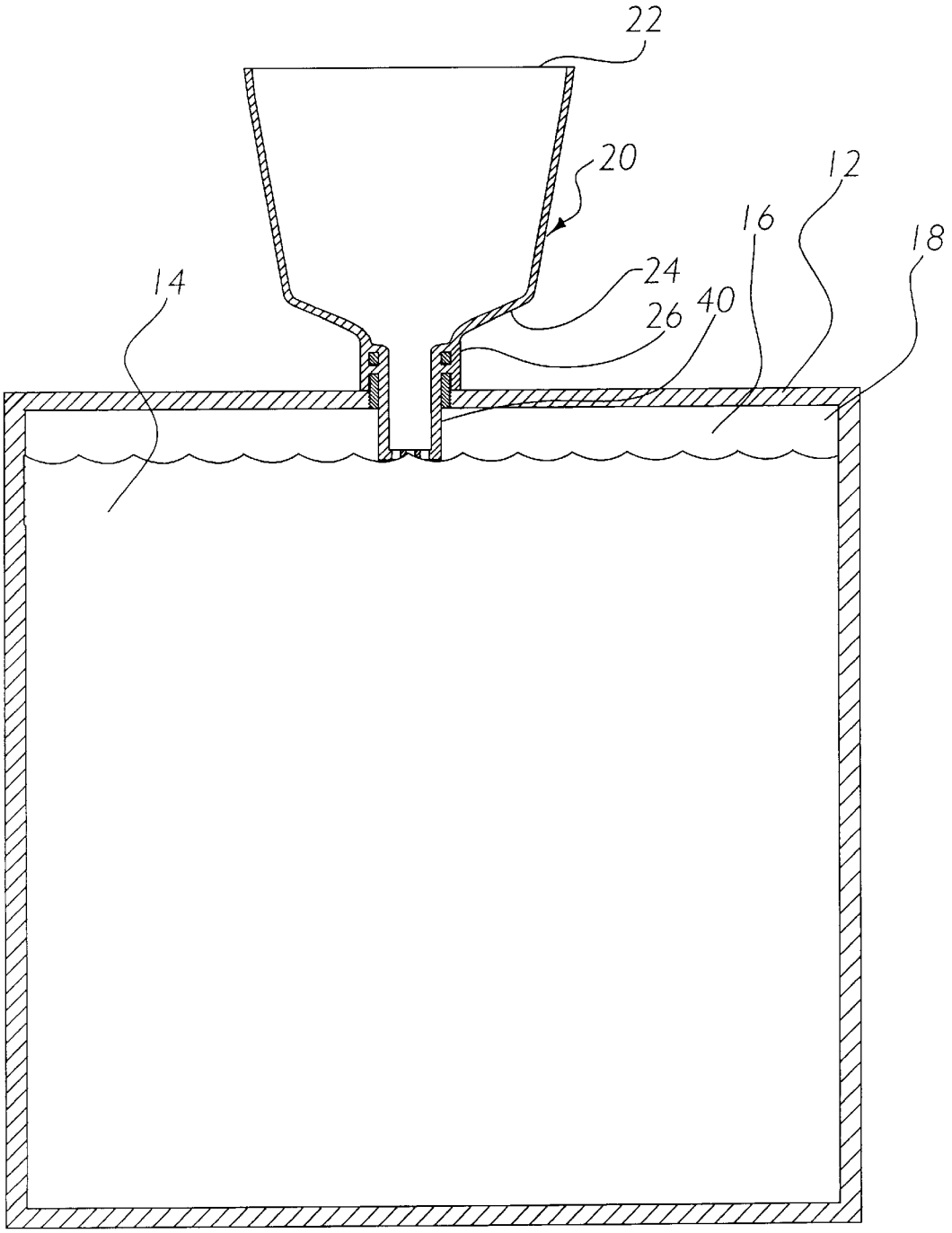
FIG. 4 is a cutaway view with the maximum liquid level within the container creating an air pocket.
Figure 5:
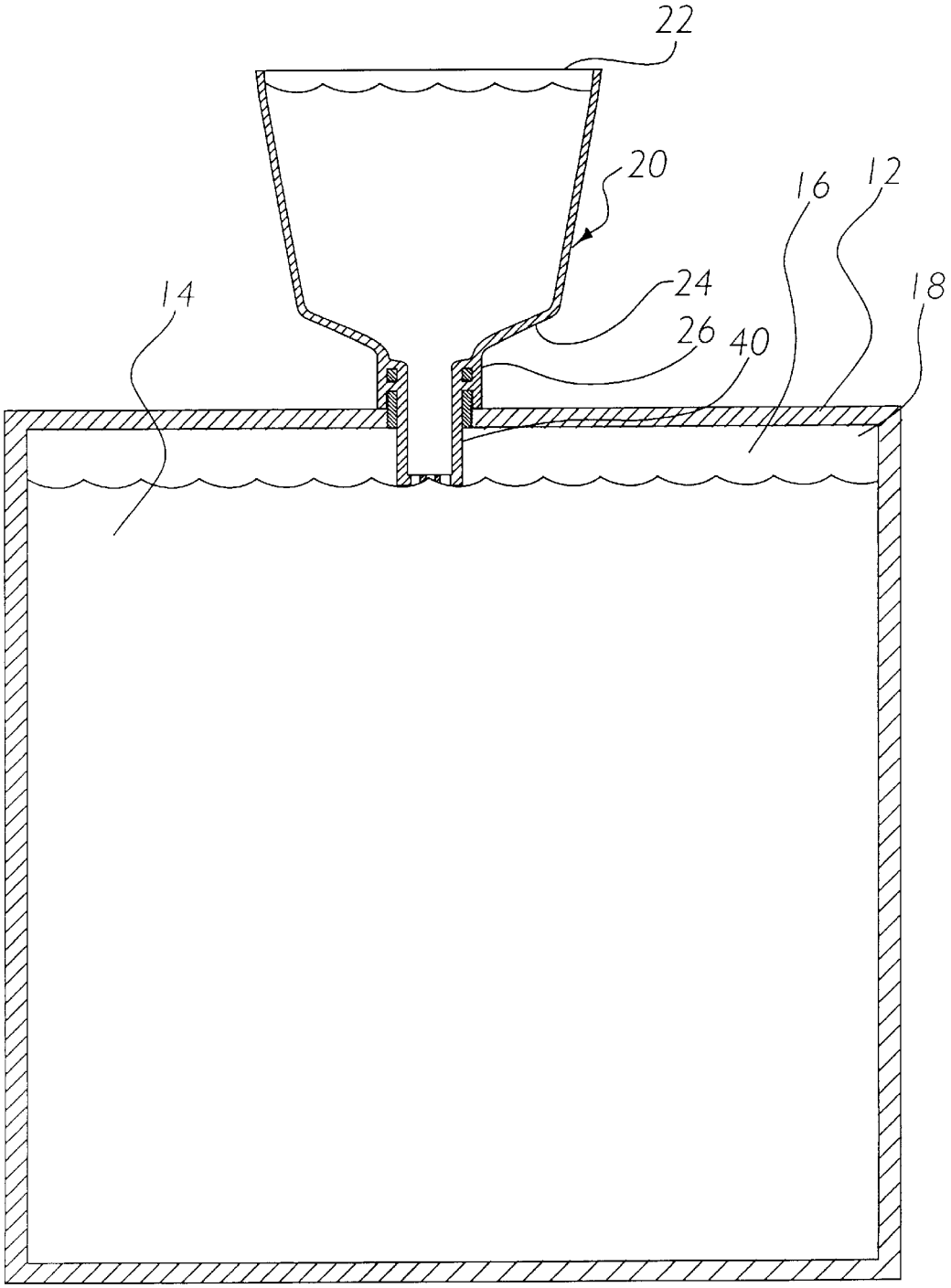
FIG. 5 is a cutaway view with the funnel member filled with the air pocket within the container of sufficient volume to receive the fluid within the funnel member.

As best shown in FIG. 2 of the drawings, the threaded nipple 30 is secured within the neck 26 of the funnel member 20. The threaded nipple 30 threadably engages an interiorly threaded connector within the container 12 as shown in FIGS. 3 through 5 of the drawings thereby creating an air tight seal for preventing air or fluid 14 from escaping around the threaded nipple 30. The threaded nipple 30 is preferably directly molded into the funnel member 20 with the plastic material positioned within at least one opening 32 within the threaded nipple 30 thereby preventing movement or removal of the threaded nipple 30 from the neck 26 of the funnel member 20.

As shown in FIGS. 2 through 5 of the drawings, an extended tube 40 extends from the neck 26 and the interior of the threaded nipple 30 a finite distance for creating an air pocket 18 within the container 12 that is preferably greater in volume than the funnel member 20. However, a smaller air pocket may be created if filling the entire funnel member 20 is not a concern. The extended tube 40 may either be directly connected to the threaded nipple 30 or molded with the funnel member 20 as shown in FIGS. 2 through 5 of the drawings. The extended tube 40 preferably is molded within the neck 26 of the funnel member 20 extending through the lumen of the threaded nipple 30 thereby providing a smooth flowing surface for the fluid 14 to flow against.

As best shown in FIG. 2 of the drawings, a filter member 44 is connected within the extended tube 40 for catching larger sized debris. The filter member 44 preferably includes a plurality of apertures 46 positioned within the filter member 44. Alternatively, a conventional screen or other convention filter device may be utilized within the extended tube 40 for catching larger sized debris.

In use, the user threadably couples the threaded nipple 30 to the interior threaded connector of the container 12 as shown in FIGS. 3 through 5 of the drawings. The user then removes the cover 28 and then begins filling the container 12 with fluid 14 such as liquid waste. During filling, the liquid level 16 within the container 12 rises and the upper air space within the container 12 becomes smaller since the air is allowed to escape through the extended tube 40 through the funnel member 20 as with a conventional funnel. As the liquid level 16 rises to the lower edge of the extended tube 40 as shown in FIG. 4, the air flow through the extended tube 40 is terminated creating an air pocket 18 that preferably has a volume larger than the entire volume of the funnel member 20. Fluid is still allowed to enter the container 12 only in a volume equal to the compressed air within the newly created air pocket 18 thereby creating a pressurized air pocket 18. The funnel member 20 begins to fill with the fluid 14 as shown in FIG. 5 thereby informing the user that the container 12 is almost full. The user terminates filling the funnel member 20 and container 12, and there after loosens the threaded nipple 30 from the container 12 thereby allowing the pressurized air within the air pocket 18 to escape thereby allowing the fluid 14 within the funnel member 20 to drain into the container 12. This continues until the fluid 14 within the funnel member 20 is drained into the container 12, where after the user may then remove the funnel member 20 from the container 12 thereby allowing the container 12 to be sealed and transported to the desired location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A funnel with spill guard, comprising:

a funnel member having an upper opening and a lower opening;

a threaded nipple positioned within said funnel member, wherein said threaded nipple includes at least one opening through a side portion thereof for receiving plastic from said funnel member;

wherein said threaded nipple is adapted to be threadably engaged to an interiorly threaded opening of a container; and a tube extending from a lower portion of said funnel member through a lumen of said threaded nipple for creating an air pocket within said container.

2. The funnel with spill guard of claim 1, wherein said tube includes a filter.

3. The funnel with spill guard of claim 2, wherein said filter comprises a molded member within said tube with a plurality of apertures.

4. The funnel with spill guard of claim 1, including a cover for enclosing said upper opening.

5. The funnel with spill guard of claim 4, including a cord secured between said funnel member and said cover.

6. The funnel with spill guard of claim 1, wherein said funnel member has a tapered body portion.

7. The funnel with spill guard of claim 1, wherein said air pocket is larger in volume than a volume of said funnel member.

* * * * *